US011602700B2

(12) United States Patent
Okhrimenko et al.

(10) Patent No.: US 11,602,700 B2
(45) Date of Patent: Mar. 14, 2023

(54) CONSTRUCTION SET ELEMENT

(71) Applicant: LIMITED LIABILITY COMPANY "TRADE HOUSE LYTAR-UKRAINE", Kyiv (UA)

(72) Inventors: Denys Viktorovych Okhrimenko, Kyiv (UA); Igor Ivanovych Liski, Luhansk (UA); Sergii Anatoliyovych Rudkovskyi, Kyiv (UA)

(73) Assignee: LIMITED LIABILITY COMPANY TRADE HOUSE "LYTAR-UKRAINE", Kyiv (UA)

( * ) Notice: Subject to any disclaimer, the term of this patent is extended or adjusted under 35 U.S.C. 154(b) by 0 days.

(21) Appl. No.: 16/982,633

(22) PCT Filed: Mar. 15, 2019

(86) PCT No.: PCT/UA2019/000034
§ 371 (c)(1),
(2) Date: Sep. 21, 2020

(87) PCT Pub. No.: WO2019/182548
PCT Pub. Date: Sep. 26, 2019

(65) Prior Publication Data

US 2021/0023469 A1 Jan. 28, 2021

(30) Foreign Application Priority Data

Mar. 21, 2018 (GB) ..... 2018 02875

(51) Int. Cl.
*A63H 33/08* (2006.01)
*A63H 33/16* (2006.01)

(52) U.S. Cl.
CPC ..... *A63H 33/086* (2013.01); *A63H 33/16* (2013.01)

(58) Field of Classification Search
CPC .... A63H 33/08; A63H 33/086; A63H 33/088; A63H 33/16
(Continued)

(56) References Cited

U.S. PATENT DOCUMENTS 2,631,747 A * 3/1953 Stolte ..... A63H 33/062 215/10
3,374,917 A * 3/1968 Troy ..... E04B 2/18 297/DIG. 2
(Continued)

FOREIGN PATENT DOCUMENTS

DE 202009013006 2/2010
GB 908097 10/1962
(Continued)

*Primary Examiner* — Joseph B Baldori
(74) *Attorney, Agent, or Firm* — Defillo & Associates, Inc; Evelyn A. Defillo

(57) ABSTRACT

The invention relates to the field of toys, including children's construction sets, and can be used during the production of elements of children's construction kits for making three-dimensional models. The present construction set element is a convex body and is provided with studs on its upper part, main grooves on its lower part, additional grooves on its side faces, and a locking button. The element is made from a contoured blank having uniform thickness of the surface formed from a pulp based on a fibrous substance. The universality of a construction set element and the combination possibilities of the elements are increased, the coupling efficiency of the construction set elements with one another is increased, and the technique for manufacturing the element is simplified.

4 Claims, 4 Drawing Sheets

(58) Field of Classification Search
USPC ..... 446/117, 124, 478, 487
See application file for complete search history.

(56) References Cited

U.S. PATENT DOCUMENTS 3,391,824 A * 7/1968 Wiseman ..... B65D 21/0235 206/509
3,412,502 A 11/1968 Riches
4,067,475 A * 1/1978 Pinkau ..... B65D 81/361 206/504
4,624,383 A * 11/1986 Moore ..... A63H 33/08 206/509
4,964,833 A * 10/1990 Suzuki ..... A63H 33/086 446/128
5,098,328 A * 3/1992 Beerens ..... A63H 33/086 446/128
5,662,508 A 9/1997 Smith
5,676,251 A * 10/1997 Credle, Jr. ..... A63H 33/086 206/501
5,709,304 A * 1/1998 Credle, Jr. ..... A63H 33/086 206/501
5,876,776 A * 3/1999 Credle, Jr. ..... A63H 33/086 426/394
5,890,595 A * 4/1999 Credle, Jr. ..... A63H 33/086 206/501
6,003,671 A * 12/1999 McDonough ..... B65D 43/162 206/493
6,371,823 B1 * 4/2002 Stavran ..... B65D 81/361 446/128
8,888,552 B2 * 11/2014 Wizenberg ..... A63H 33/086 446/102
2006/0261063 A1 * 11/2006 Dyehouse ..... B65D 21/0204 220/23.4
2009/0090647 A1 * 4/2009 Panchal ..... B65D 81/361 206/504
2009/0117815 A1 * 5/2009 Hiraide ..... A63H 33/086 446/124
2014/0262896 A1 * 9/2014 Ficko ..... B65D 21/0202 206/457
2014/0263299 A1 * 9/2014 Marschall ..... B65D 21/0204 220/4.01
2015/0069064 A1 * 3/2015 Johnson ..... B65D 43/162 220/324
2020/0054957 A1 * 2/2020 Chan ..... A63H 33/08
2020/0087050 A1 * 3/2020 Seichei ..... E04B 2/02

FOREIGN PATENT DOCUMENTS

RU 12799 2/2000
RU 16779 2/2001
RU 38116 5/2004
WO WO00/06278 2/2000
WO WO2017/125723 7/2017
WO WO2018/015902 1/2018

* cited by examiner

CONSTRUCTION SET ELEMENT

CROSS REFERENCE TO RELATED APPLICATION

This application is a national stage entry of PCT/UA2019/000034 filed Mar. 15, 2019, under the International Convention claiming priority over Ukraine Patent Application No. u 2018 02875 filed Mar. 21, 2018.

FIELD OF THE INVENTION

This invention relates to the field of toys, in particular to children's construction sets, and can be used in manufacture of children's construction kit elements for making three-dimensional models.

BACKGROUND OF THE INVENTION

The prior art discloses a construction set consisting of blocks including each the box-shaped body with one or more connecting elements on the top part thereof, and its lower part is provided with connecting means in the form of groove, ensuring the possibility of detachable joining the blocks with each other by introducing a connecting element or elements of one block into the groove of another. The above said construction set is characterized in that for the purpose of coupling the blocks at different clearly fixed angles, being multiples of 360°/n, where n is an integer, desirably paired, and preferably a multiple of 4, the bodies of the blocks and, accordingly, the coupling grooves are made in the form of one or a plurality of regular and coaxial h-angles, and each connecting element has a form of a regular h-gon or any other figure that fits into this h-gon and adjoins all its sides [RU M° 2003 131 539 A, A63H 33/08, 2005].

From the prior art, it is known a construction set, each member of which includes at least one flat five-, four- and three-sided plastic element with fixing protrusions and depressions alternating on each side of the elements, and those being arranged with the possibility of locating the protrusions of one element in the depressions of the other element. The above said construction set is characterized in that each fixing depression of those elements is manufactured to have a protruding element with a thickened head at the end portion thereof, and each protrusion is manufactured to have a recess for coupling the protrusion to the thickened head of the protruding element, and on the both sides of the recess, the protrusions are made with slots being close to the recess [RU° 12799 UI, A63H 33/08, 2000].

The prior art includes a known toy construction kit including a set of modules, each of which has connecting elements for coupling the modules to each other. The modules are manufactured to have a cruciform, flat, and triangular form, while the connecting elements are in the form of the cruciform protrusions of the rectangular plates and the cruciform and rectangular grooves being corresponding thereto [RU M° 38116 U 1, A63H 33/08, 2004].

There is a known children's construction set element representing a component part with recesses. This is an elongated bar in the form of a parallelepiped of any length made of any natural or synthetic material. In its cross-section, the bar is formed of a rectangular shape. At least one side of the bar is manufactured with at least one recess in the form of a square transverse groove, the so-called lock, the depth of which is four times less than the width of the bar side being adjacent to the lock [UA JVe 64405, A63H 33/00, 2011].

The closest to the claimed invention is a construction set element including a case in the form of a convex body, and on the surface of the body, there are the segments covered with the textile fasteners and micro hooks, and also the segments covered with the textile fasteners and felt. The number of the segments on the surface of the convex body covered with the textile fasteners and micro hooks is at least four, the number of the segments on the surface of the convex body covered with the fasteners and felt is at least four, and the segments covered with the textile fasteners and micro hooks alternate with the segments covered with the textile fasteners and felt [RU N° 116779 U 1, A63H 33/08, 2011].

The specified construction set elements, like the previous analogs, have insufficient universality and coupling efficiency to each other. The technique for manufacturing the above said element is rather complex.

SUMMARY OF THE INVENTION

The basis of the invention is to solve the technical problems of increasing the universality of the construction set elements as well as the combinatorial capabilities thereof, and also to upgrade the coupling efficiency of the construction set elements to each other and simplify the technique for manufacturing the above said elements.

The problem is solved by the fact that in a construction set element made in the form of a convex body with fixing elements in the form of studs and grooves, according to the invention, the studs are made on the upper part of the element, the main grooves are manufactured in the lower part of the element, the additional grooves are formed on the side faces of the element, while the above element is made of a contoured blank having uniform thickness of the surface formed from a pulp based on a fibrous substance.

Cellulose can be used as a pulp.

The constructor element has a locking button.

An unassembled construction set element has two open halves.

With the help of the claimed kit of the construction set elements, children can build houses and facilities for their games to play.

The technique for manufacturing a construction set element made of a contoured blank having uniform thickness of the surface formed from a pulp based on a fibrous substance, for example, cellulose, is quite simple.

The universality of the construction set elements as well as the combinatorial capabilities thereof have been increased. The coupling efficiency of the construction set elements to each other is enhanced by making additional grooves on the side faces of the element.

The shapes of the above construction set elements allow storing them rather compactly while nesting one element into another in an unassembled form, which makes it easier and more convenient to transport a lot of the elements of such a construction set.

BRIEF DESCRIPTION OF THE DRAWINGS

The invention is illustrated by the following drawings.

DETAILED DESCRIPTION OF THE INVENTION

Figure 1:
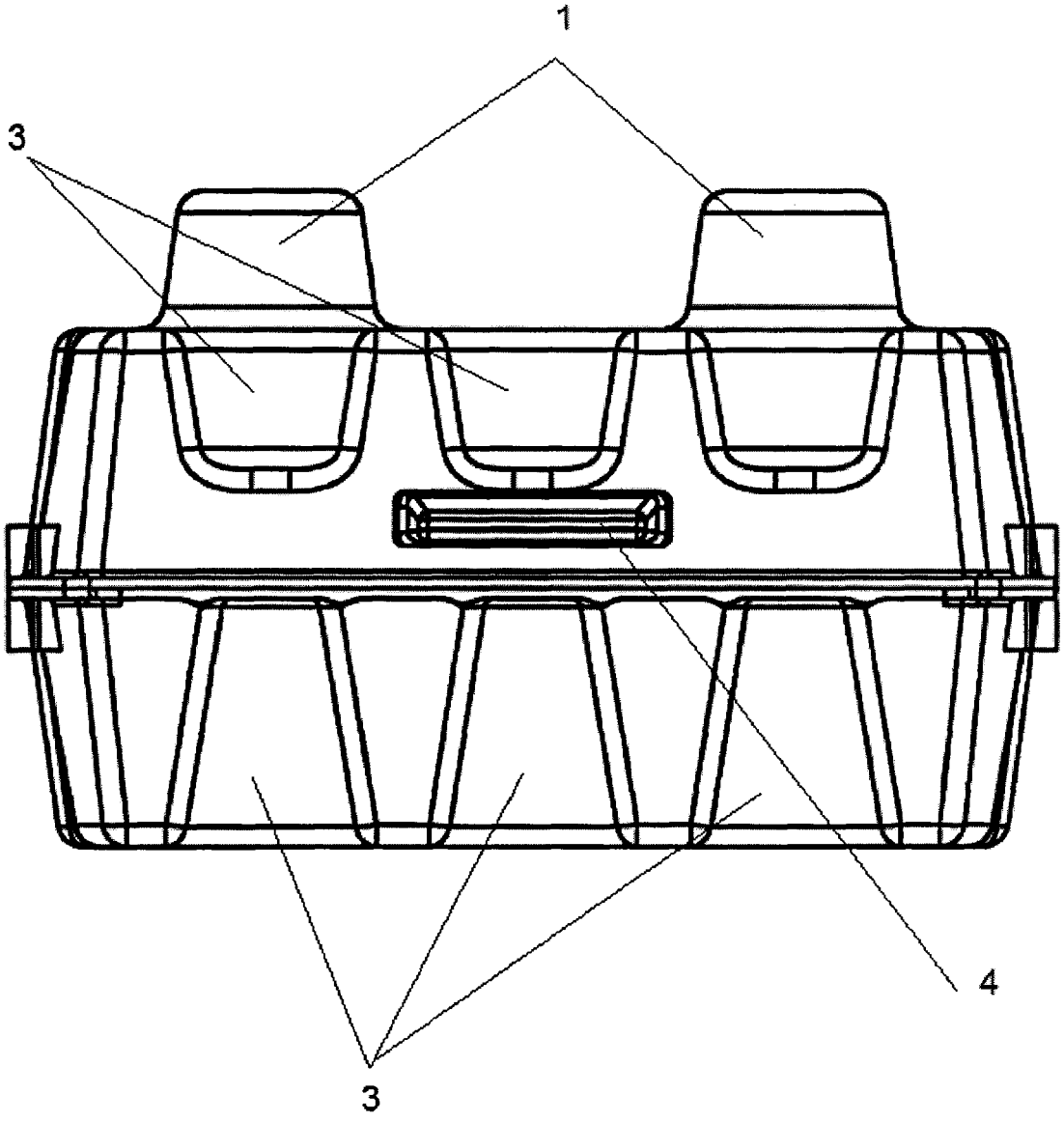
FIG. 1 shows the completely built element of the construction set, the front view.
Figure 2:
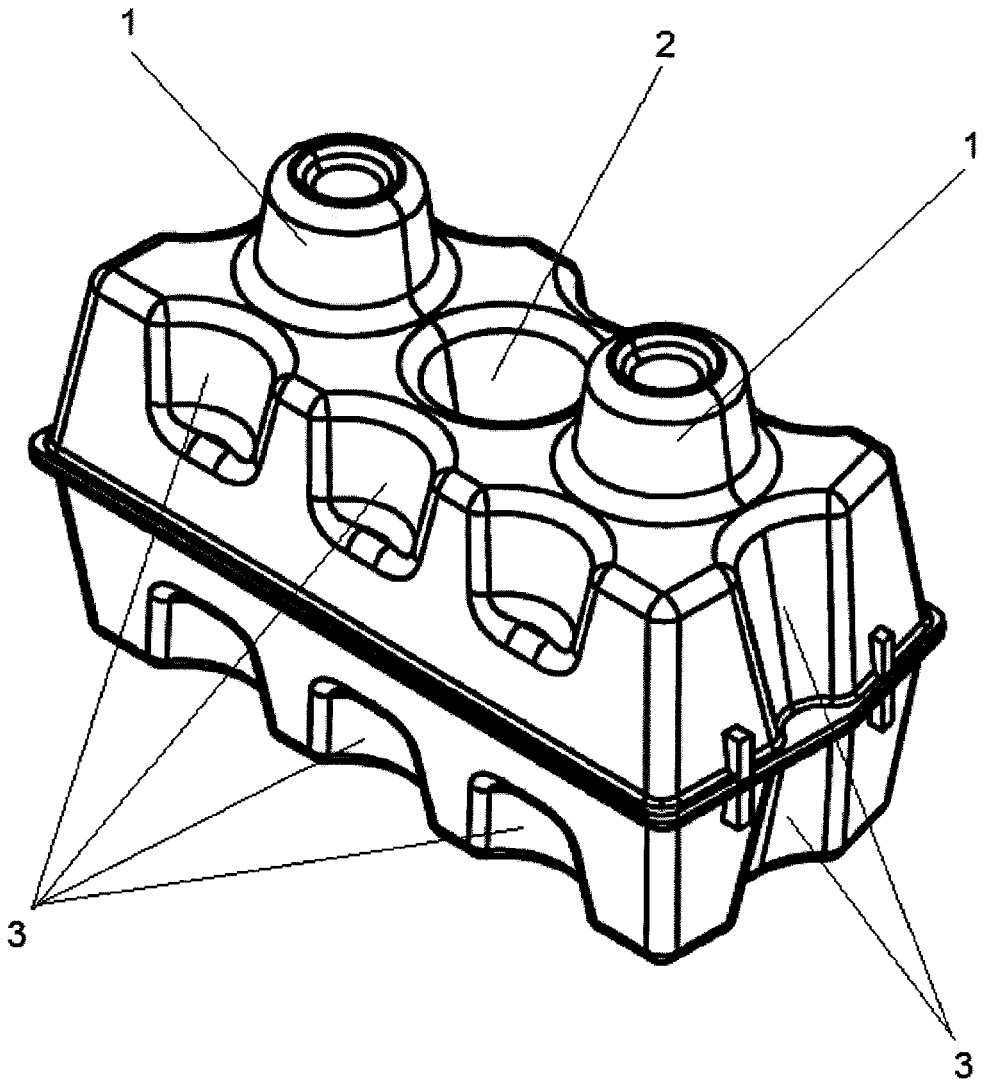
FIG. 2 shows the completely built element of the construction set, the angle view.
Figure 3:
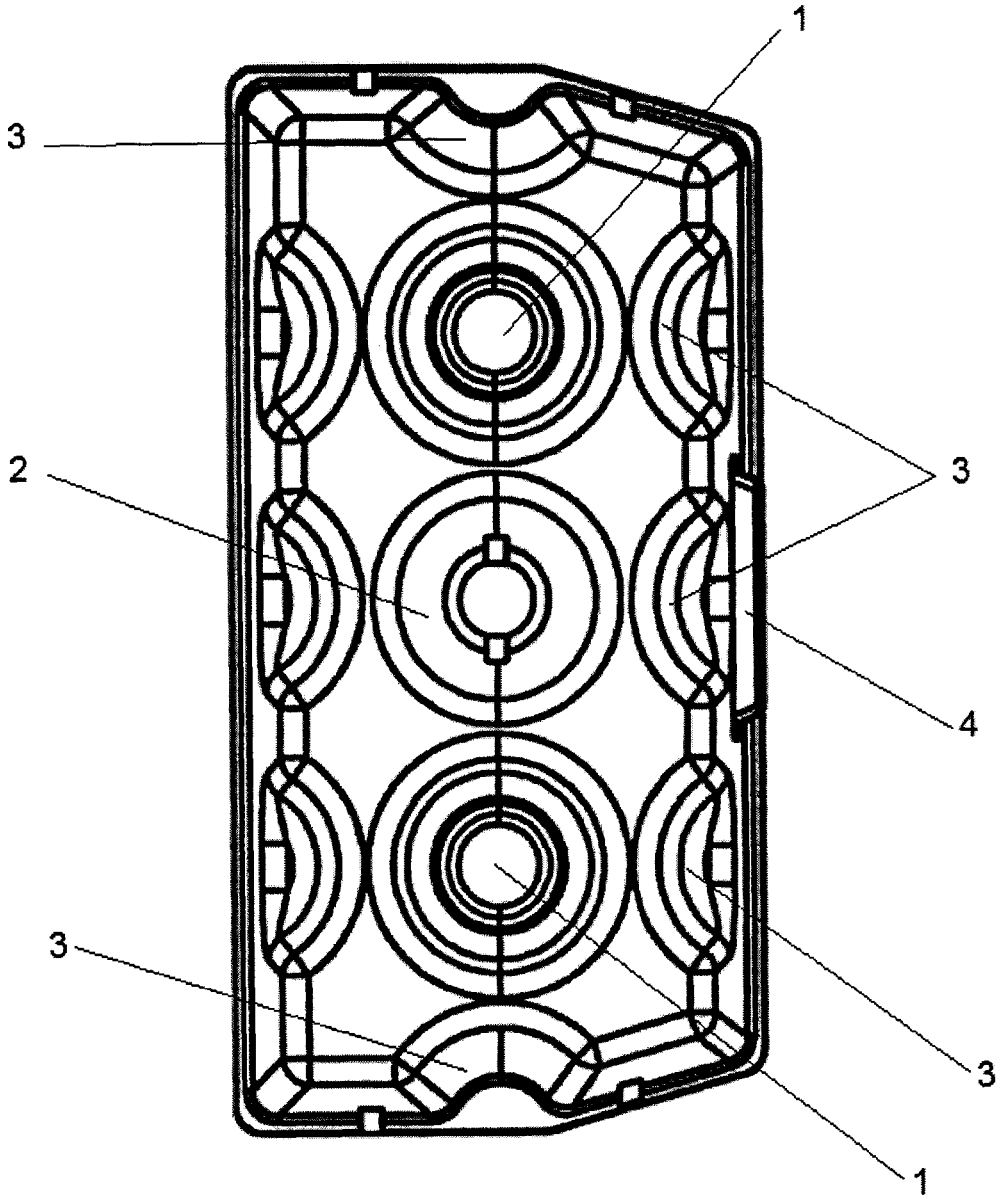
FIG. 3 shows the completely built element of the construction set, top view.
Figure 4:
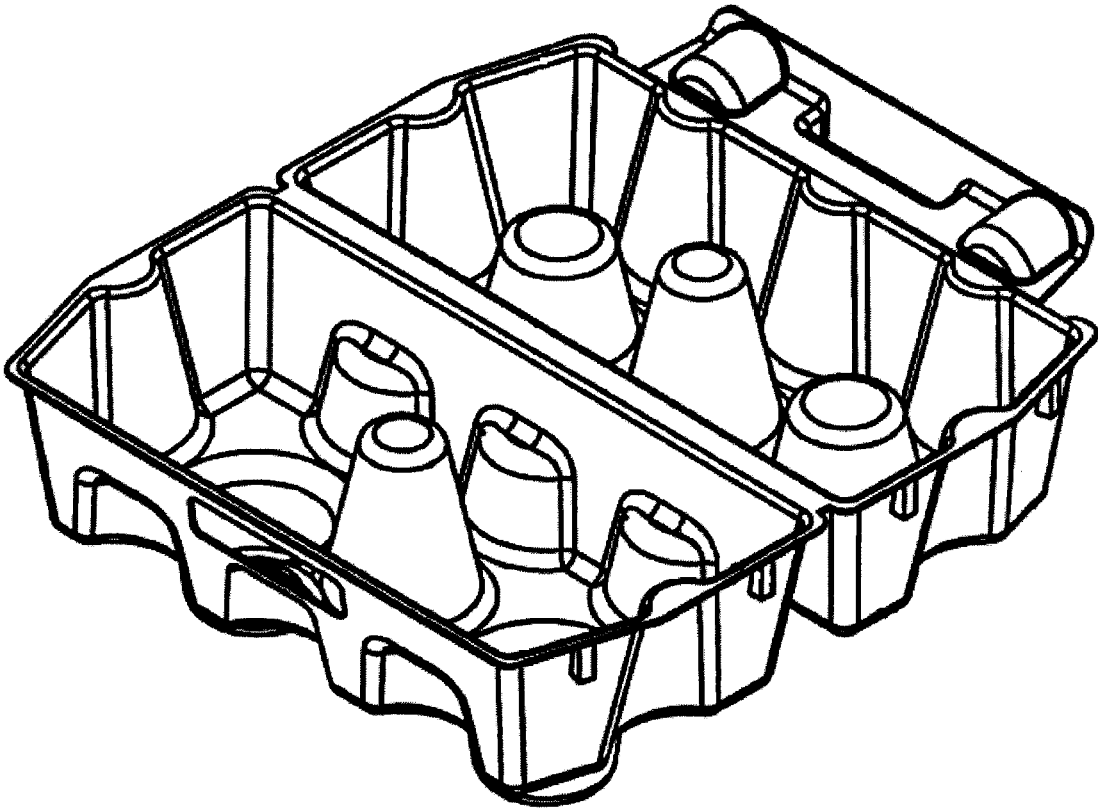
FIG. 4 shows the element of the construction set in an open and unassembled form.

The construction set element is of a three-dimensional configuration. In a built and ready-to-use state, it includes the following component parts: on the upper portion of the element there are studs 1, in the lower part of the element, there are main grooves 2, on the side faces of the element, there are additional grooves 3, and the element has locking button 4.

The element is made of a contoured blank having uniform thickness of the surface formed from a pulp based on a fibrous substance, for example, such as cellulose. It is built forming a three-dimensional construction set element fixed in a built state by locking button 4.

In the ready-to-use state, the construction set element is coupled to the neighboring elements by coupling studs 1 to main grooves 2. At the same time, additional side grooves 3 allow coupling the elements of the construction set in various configurations.

The invention claimed is:

1. A construction element comprising:

a convex body having:

a first half section including an upper end and side faces, the upper end having studs and main grooves, the studs and the main grooves are aligned on a central axis of the first half section;

a second half section including a lower end and side faces, the lower end including grooves aligned on a central axis of the second half section;

secondary grooves aligned to each other and located on: the side faces and the upper end of the first half section of the convex body and on the side faces of the second half section of the convex body;

a locking button to secure the first half section to the second half section;

wherein the convex body is made of a pulp based on a fibrous substance.

2. The construction set element as set forth in claim 1, wherein the pulp is cellulose.

3. The construction set element as set forth in claim 1, wherein the first half section and the second half section can be disassembled.

4. A kit comprising a plurality of construction elements according to claim 1, wherein the construction elements are joined together by coupling the studs into the main grooves and the secondary grooves of adjacent construction elements.

* * * * *